US007884721B2

(12) United States Patent
Gibson

(10) Patent No.: US 7,884,721 B2
(45) Date of Patent: Feb. 8, 2011

(54) DEVICES FOR IDENTIFYING AND TRACKING WIRELESS MICROPHONES

(76) Inventor: James Edward Gibson, 4738 S. Holland Ave., Springfield, MO (US) 65810

( * ) Notice: Subject to any disclaimer, the term of this patent is extended or adjusted under 35 U.S.C. 154(b) by 241 days.

(21) Appl. No.: 12/229,486

(22) Filed: Aug. 25, 2008

(65) Prior Publication Data

US 2010/0045462 A1 Feb. 25, 2010

(51) Int. Cl.
*G08B 13/14* (2006.01)

(52) U.S. Cl. ..... 340/572.1; 340/539.13; 381/58; 381/122

(58) Field of Classification Search ..... 340/572.1, 340/539.13, 539.32; 381/58, 122
See application file for complete search history.

(56) References Cited

U.S. PATENT DOCUMENTS 5,677,673 A * 10/1997 Kipnis ..... 340/539.32
7,253,735 B2 * 8/2007 Gengel et al. ..... 340/572.7
7,298,251 B2 * 11/2007 Meyers et al. ..... 340/505
7,395,966 B2 * 7/2008 Braiman ..... 235/454

* cited by examiner

*Primary Examiner*—Jeffery Hofsass

(57) ABSTRACT

The invention is a system for remotely identifying sound amplification devices and other electronic devices. This system introduces the ability for sound technicians to remotely identify which electronic devices have entered the stage or performance area. The system includes an identification tags, visual markers, sensors, receiver, and monitor. Remote identification can be achieved through RFID (radio frequency identification) or Line of sight (like infrared). Using directional sensors or sensors of adjustable sensitivity.

4 Claims, 3 Drawing Sheets

Stage Area (Top View)

Sensors (C)

Surrounding stage area or in vicinity of performance

Sound Board (side view)

Figure (5)
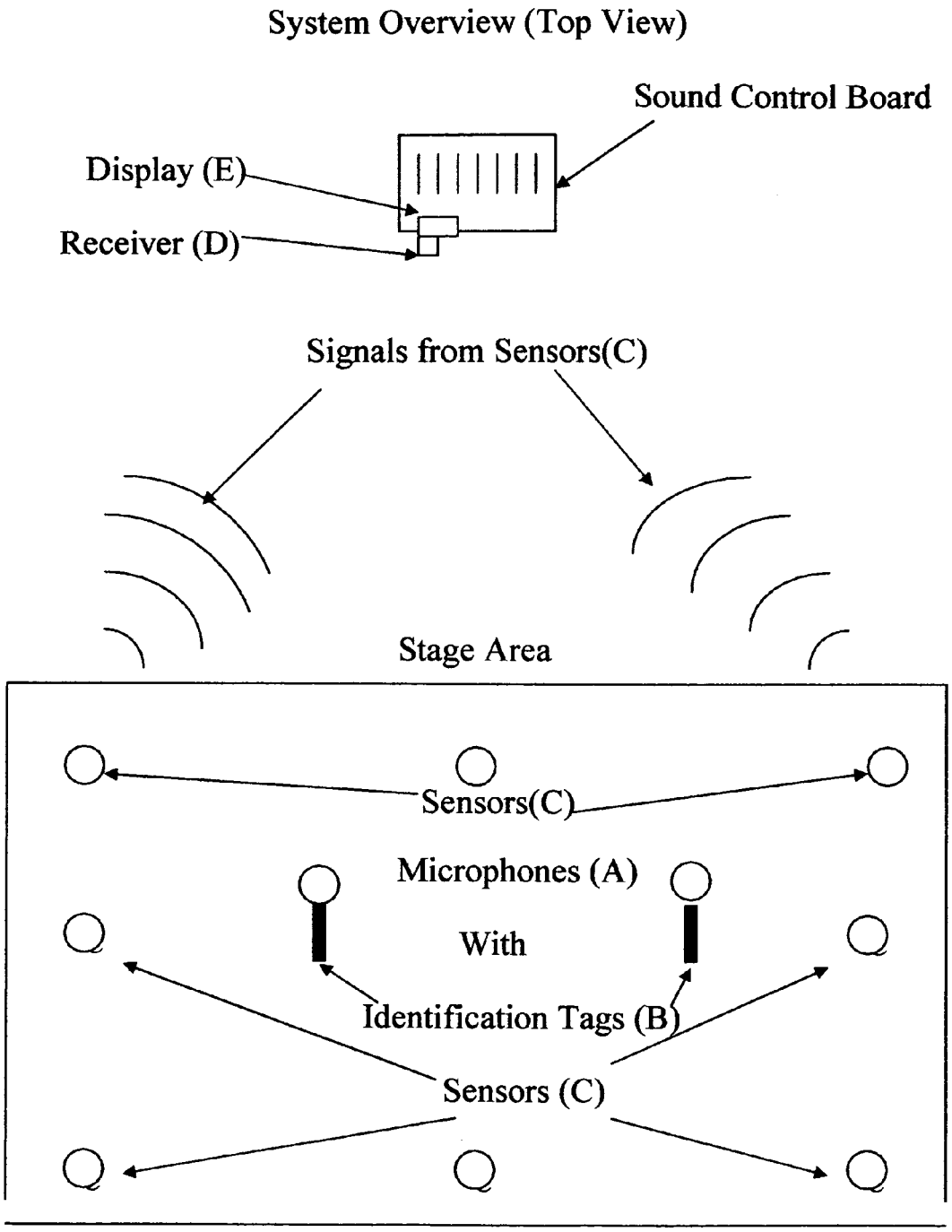

DEVICES FOR IDENTIFYING AND TRACKING WIRELESS MICROPHONES

EXISTING RELATED PATENTS

U.S. Pat. No. 7,395,966—tracking system using optical tags

U.S. Pat. No. 7,253,735—RFID tags and processes for producing RFID tags

U.S. Pat. No. 7,298,251—Handheld RFID reader with Dipole Antenna

FEDERALLY FUNDED SPONSORED RESEARCH

Not applicable.

REFERENCE TO SEQUENCE LISTING

Not applicable.

BACKGROUND OF THE INVENTION

This invention relates to the remote tracking of wireless sound amplification devices (microphones) and other electronic devices in public address performance settings. The invention solves the problem of sound technicians being unable to tell which microphone is currently on stage and to appropriately control the use of each wireless microphone.

SUMMARY OF THE INVENTION

In public address performances where sound amplification is required, wireless microphones are often used. When multiple performers share microphones and pass them from one performer to another, or exchange them backstage, or acquire them backstage, it is often difficult for the sound technician(s) who control sound and lighting in a performance to know which devices to turn off and on at specific times in the performance.

The invention uses remote sensing technology such as RFID tags, sensors and readouts, or line of sight technology (such as infrared identification), to identify which microphone or other device is currently on-stage.

Proper identification of a microphone on stage reduces or eliminates the awkward situations that arise when a performer starts their performance and there is no amplification. Proper identification also prevents the embarrassment that occurs when wireless microphones are accidentally turned on backstage, and unwanted noise, or conversation is amplified into the audience's hearing.

BRIEF DESCRIPTION OF THE DRAWINGS

FIG. 5—shows how the whole system works together. Performers are on stage with microphones (A) or other devices that have sensors (B) attached. Sensors (C) relay which devices are on stage at any given moment to receiver (D). Receiver (D) relays that information to display or readout device (E). Markers (F) corresponding to ID Tags and placed on soundboard allow sound technician to turn on and adjust volume for correct microphone. Identifying signal from (B) corresponds to Marker (F) on soundboard. This enables the sound technician to identify which microphones need to be turned on or off.

DETAILED DESCRIPTION OF THE INVENTION

Figure 1:
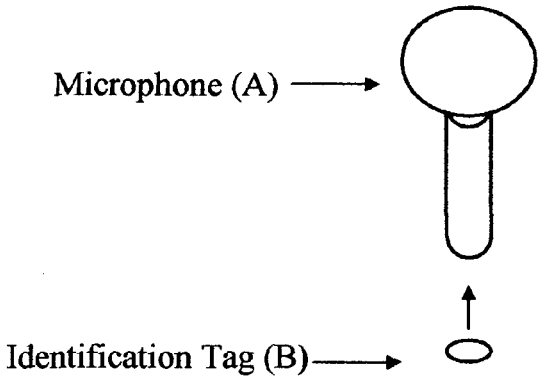
FIG. 1—shows microphone (A) receiving application of Identification Tag (B).
Figure 2:
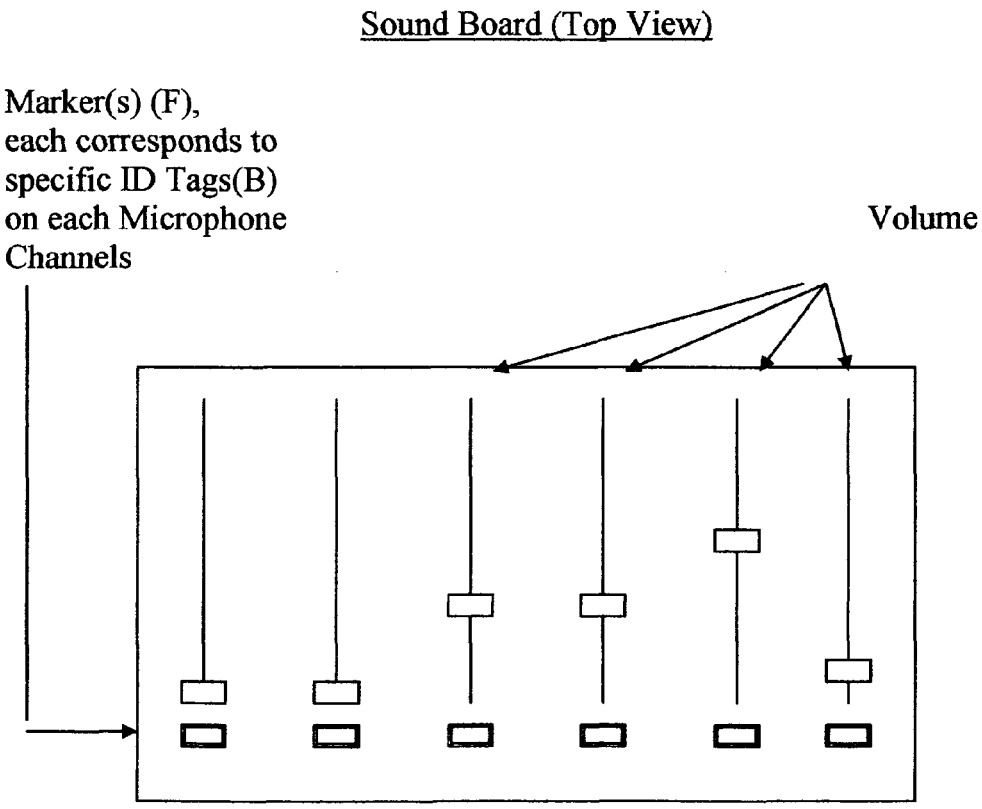
FIG. 2—shows marker (F) which corresponds to Identification tag (B) placed on volume channels on sound board.
Figure 3:
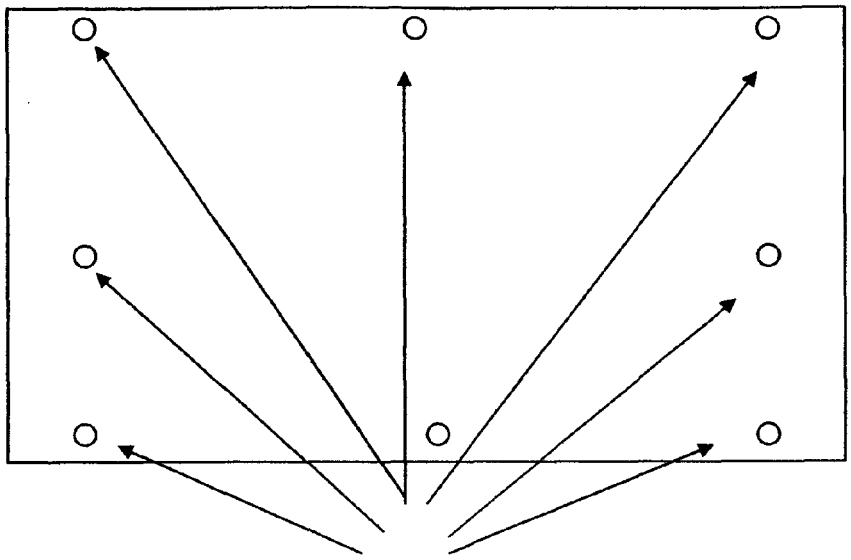
FIG. 3—shows signal sensors (C) placed on the stage, or performance area.
Figure 4:
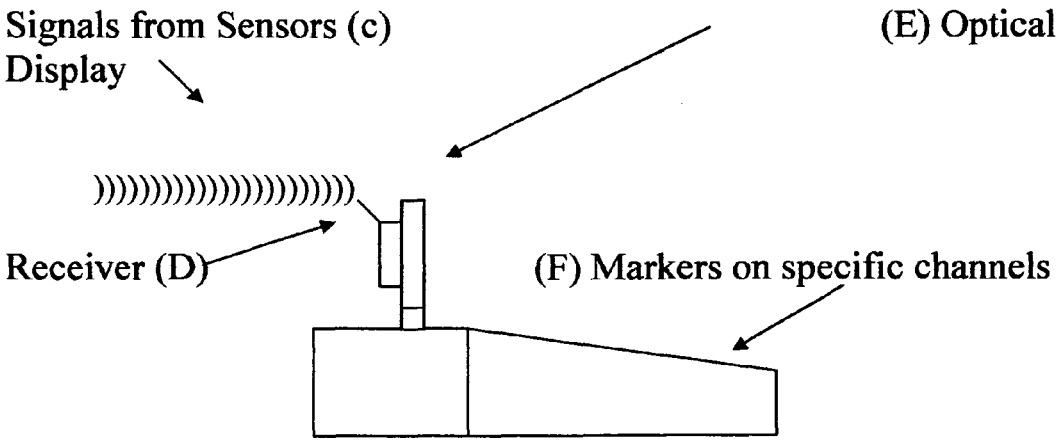
FIG. 4—shows signal receiver (D) and corresponding display or readout device (E) to show which devices (B) are being sensed by sensors (C).

Identification tags (B) bearing a unique signature (number, frequency, color of light, magnetic signature, etc) that are remotely sensible by one or more means (RFID, or Infrared (line of sight)) are attached to microphones or electronic devices (A). Visual markers (F) bearing corresponding Identification information from (B) are attached to volume control channels on soundboard to designate which channel corresponds to which microphone.

Sensors (C) that correspond to and can receive the signals from identification tags (B) are placed on the stage or in the auditorium to pickup the identifying signal from the tags (B). Such sensors can be adjustable to receive signals only within the designated area, or directional (receiving signals only from a specified range or angle) so that they can be set around the perimeter of a performance area and will only receive signals that originate within perimeter.

Sensors (C) relay the identifying signal to a receiver (D) near the sound technician.

Receiver (D) relays that identifying information to a display or readout device (E).

Sound technician, turns on specific microphone marked by marker (F) that corresponds to ID signal displayed on monitor.

This information allows the sound technician to only turn on the appropriate microphones or other devices, and to do so in a timely manner.

Narrative of System Operation:

1 Performer enters stage area with microphone.

2 Signal from ID Tag (B) on Microphone (A) is transferred to Sensors (C).

3 Receiver (D) receives signal from (C) and transfers signal to display (E).

4 Sound technician turns on channel marked by marker (F) with corresponding ID information shown on display.

5 Performer completes performance.

6 Sound technician turns off correct microphone as performer leaves stage area.

7 Microphone ID is shown as no longer on stage.

Summary: With the above system the sound technician is able to turn on the correct sound channel for the microphone that is to be used at the correct time in the performance.

The invention claimed is:

1. A system to remotely identify wireless microphones and other electronic devices in a public address system, the system comprising an identification tag, a sound board marker that corresponds to the identification tag, a sensor to remotely identify the tag, a receiver to retrieve the signal from the sensor and a monitor to display the information to a user of the sound board.

2. The system of claim 1 wherein the remote identification is accomplished by RFID (Radio Frequency Identification) tags and sensors.

3. The system of claim 1 wherein the remote identification is accomplished by line of sight identification tags and sensors.

4. The system of claim 2 or 3 wherein the sensors of the RFID tags or line of sight tags are adjustable to only receive signals of a designated strength or of a directional receptivity to better determine when electronic devices bearing ID tags enter a stage area.

* * * * *